US005295839A

United States Patent [19]

Grange et al.

[11] Patent Number: 5,295,839

[45] Date of Patent: Mar. 22, 1994

[54] METHOD AND SYSTEM FOR INTERCONNECTINGLY ENGAGING CIRCUITS

[75] Inventors: Jeffrey J. Grange, Brush Prairie, Wash.; J. P. Harmon, Corvallis, Oreg.

[73] Assignee: Hewlett-Packard Company, Palo Alto, Calif.

[21] Appl. No.: 33,691

[22] Filed: Mar. 16, 1993

[51] Int. Cl.[5] ..... H01R 23/66

[52] U.S. Cl. ..... 439/67; 439/493; 439/824

[58] Field of Search ..... 439/67, 77, 493, 824

[56] References Cited

U.S. PATENT DOCUMENTS

| | | | |
|---|---|---|---|
| 4,417,776 | 11/1983 | Motoyama | 439/824 |
| 4,577,200 | 3/1986 | Rix et al. | 346/140 R |
| 4,706,097 | 11/1987 | Harmon | 346/139 C |
| 4,755,836 | 7/1988 | Ta et al. | 346/140 R |
| 4,849,772 | 7/1989 | Ten Broeck et al. | 346/139 R |
| 4,862,197 | 8/1989 | Stoffel | 346/140 R |
| 4,871,315 | 10/1989 | Noschese | 439/67 |
| 4,872,026 | 10/1989 | Rasmussen et al. | 346/140 R |
| 4,881,901 | 11/1989 | Mendenhall et al. | 439/67 |

OTHER PUBLICATIONS

Roy T. Buck, Printhead Interconnect, May 1985, Hewlett-Packard Journal (p. 14).

*Primary Examiner*—Gary F. Paumen

[57] ABSTRACT

A system is provided for effectively and efficiently interconnecting a first rigid circuit with a second rigid circuit. The interconnected circuit system includes, in addition to the first and second circuits, a compressive conductive member and a rigid conductive member. The first circuit has means for interconnecting engagement with the compressive conductive member. The second circuit has means for interconnecting engagement with the rigid conductive member. The compressive conductive member has a first end for interconnecting engagement with the first circuit and a second end for interconnecting engagement with a first end of the rigid conductive member. The rigid conductive member has a first end for interconnecting engagement with the compressive conductive member and a second end for interconnecting engagement with the second circuit. The first end of the compressive conductive member interconnectingly engages with the first end of the rigid conductive member. The second end of the rigid conductive member interconnectingly engages with the first circuit and the second end of the compressive conductive member interconnectingly engages with the second circuit. In this way, the first circuit and the second circuit together form a completed electrical circuit.

19 Claims, 1 Drawing Sheet

METHOD AND SYSTEM FOR INTERCONNECTINGLY ENGAGING CIRCUITS

BACKGROUND OF THE INVENTION

This invention relates generally to the electrical interconnection of circuits, and more particularly to such interconnects which are especially adapted for making external electrical connections to thermal ink jet printheads.

It is known to provide heater resistors on a common substrate, such as silicon, and employ these resistors to transfer thermal energy to corresponding adjacent ink reservoirs during a thermal ink jet printing operation in the manufacture of thin film resistors substrates for thermal ink jet printheads. This thermal energy will cause the ink in the reservoirs to be heated to boiling and thereby be ejected through an orifice in an adjacent nozzle plate from which it is directed onto a print medium. These heater resistors are electrically pulsed during such operation by current applied thereto via conductive traces formed on top of the silicon substrates and insulated therefrom by an intermediate dielectric layer. The formation of an intermediate dielectric layer, the formation of the resistive layer for the heater resistors, and the aluminum evaporation of sputtering process for forming electrical patterns of conductive trace material to the heater resistors are all well known in the art and therefore are not described in further detail herein. The processes used in the fabrication of thermal ink jet printheads are discussed in the Hewlett Packard Journal, Volume 36, Number 5, May 1985 ("HP Journal Article"), which is incorporated herein by reference. Hewlett Packard Corporation is the assignee of the entire right, title and interest in the subject patent application.

Electrical connections are provided between external pulse drive circuits and the conductive traces on the thermal ink jet printhead using flex or "flex" circuits to make removable pressure contacts to certain conductive terminal pads on thin film resistor printhead substrates or to tape automated bonding (TAB) circuits. These electrical connections are facilitated by applying pressure to the flex circuit so that the electrical leads therein make good electrical connection with corresponding mating pads on the thin film resistor printhead substrate. These flex circuit generally comprise photolithographically defined conductive patterns formed by various etching processes carried out on a thin flex insulating substrate member. The electrical contact locations on the flex circuit will be raised slightly in a bump and dimple configuration. This configuration is formed using a punch structure which matches the location of the correspondingly dimples. The punch structure is used to form the electrical contact locations on the flex circuit at raised locations above the surface of the insulating substrate member. During this punch process, it sometimes happens that not all of the raised contact bumps in the flex circuit are moved the same distance above the insulating substrate surface thereby producing a nonuniform dimple configuration. For this reason, more force is necessary to make contact with the smaller, or lower height bumps than those higher bumps more extended from the surface of the flex circuit. When a significant force is exerted against the flex circuit by the printhead in order to interconnect same, crushing of a portion of the raised dimple structure will result. Furthermore, the presence of a nonuniform dimple configuration will prevent contact of the printhead and flex circuit at their interface.

Other problems result from the use of a dimpled configuration per se. The raised dimple structure formation process is expensive to fabricate and requires high contact forces in its implementation. Moreover, there is poor control over the point geometry of that formation process. Spacing of the dimples in the overall dimple configuration is also a problem because they need to be spaced a relatively close intervals. However, spacing is limited by the thickness and fragility of the metal employed to form the dimpled structure. The close spaced dimpled structure, which is unique to ink jet printing, is quite difficult to manufacture.

Contact between the flex circuit and conductive pads on the TAB circuit can be maintained by using an elastomeric material, such as rubber, which has been preformed to have a plurality of cones spaced at locations corresponding to the location of the dimples in the flex circuit. The tips of these elastomeric cones can be inserted into the dimples of the flex circuit and urged thereagainst with a force sufficient to bring the conductive bumps on the flex circuit in to good physical and electrical contact with the terminal pads on the TAB circuit.

A contact array (see FIG. 1 of the HP Journal Article) can be integrated with a flex printed circuit that carries the electrical drive pulses to the printhead. Connector mating is achieved by aligning the printhead cartridge registration pins with the mating holes in the carriage/interconnect assembly and then rotating a cam latch upward or pivoting the printhead into position. In this way, electrical contact can be made without lateral motion between the contact halves. The contact areas are backed with silicon-rubber pressure pads (see FIG. 2 of the HP Journal Article) which allow electrical contact to be maintained over a range of conditions and manufacturing tolerances. Electrical contact is enhanced by dimpling the flex circuit pads. The dimples are formed on the flex circuit before the plating is applied.

While the above prior art approach to making electrical contact between the flex circuit and the print-head substrate has proven satisfactory for certain types of interconnect patterns with few interconnect members, it has not been entirely satisfactory for low voltage signal contacts. This fact has been a result of the nature of the nonlinear deflection of the above elastomeric cones. This nonlinear deflection of the elastomeric cones is seen as a nonlinear variation of cone volumetric compression, "V", as a function of the distance, "D", that the tip of the cone is moved during an interconnect operation. Thus, this nonlinear characteristic tends to increase the amount of force which must be applied to the flex circuit in order to insure that all the bumps on the flex circuit make good electrical contact with the conductive traces of terminal pads on the printhead substrate. In some cases this required force is sufficiently large to fracture the substrate or do other structural damage thereto. This non-linear deflection characteristic of the prior art is described in more detail below with reference to the prior art FIGS. 1A and 1B of U.S. Pat. No. 4,706,097, which is incorporated herein by reference.

In order to reduce the amount of force required to insure good electrical contact between a flex circuit and a TAB circuit for a thermal ink jet printhead, a novel, nearly-linear spring connect structure for placing the flex circuit into good electrical contact with contact pads on the printhead substrate with a minimum of force applied thereto was developed. This structure is set forth in the U.S. Pat. No. 4,706,097 patent. This spring connect structure includes a central locating member having a plurality of cylinders extending integrally therethrough and therefrom to a predetermined distance from each major surface of the central locating member. Cone-shaped tips located at upper ends of the elastomeric deflectable cylinders are inserted into dimples of the flex circuit with a force sufficient to bring the electrical bumps or pads above the dimples into good electrical contact with mating conductive contact pads on the printhead substrate. The volumetric deformation of the elastomeric deflectable cylinders varies substantially linearly as a function of the force applied to the lower ends of these cylinders. This feature enables the vertical displacement of the cylinder walls to be maximized for a given force applied to these cylinder.

The above-described rubber parts present a problem to the user. More specifically, in order to function in the manner described above, the rubber components must be manufactured to a high level of precision. However, precision rubber components are difficult at best to manufacture.

SUMMARY OF THE INVENTION

The subject invention overcomes the problems associated with the prior art interconnected devices by providing a system which is capable of effectively and efficiently interconnecting a rigid circuit, in the form of a rigid circuit board or stiffened flex circuit, with a flex circuit. The system of the present invention can be employed in conjunction with circuits including a nonuniform raised dimple configuration. In spite of this, a good contact between the circuits at their interface can be maintained. Therefore, when a significant force is exerted for purposes of interconnectingly engagement, crushing of the raised dimple structure will not result. In fact, the flex circuit no longer requires the dimples described in U.S. Pat. No. 4,706,097 in order to form a completed electrical circuit. In this way, a good electrical contact will exist between the respective rigid and flex circuits.

With respect to the flex circuit, it has a first and a second major surface. The system itself also includes a rigid conductive member having a first end for interconnecting engagement with the rigid circuit and a second end for interconnecting engagement with the first major surface of the flex circuit. The rigid conductive member is preferably fabricated of a metallic material. The first end of the rigid conductive member can be formed in a substantially round or pointed configuration.

A compressive member is provided having a first end for interconnecting engagement with the second major surface of the flex circuit. The compressive member compressively urges the rigid conductive member for interconnecting engagement against the rigid circuit. Typically, the compressive conductive member comprises a spring member, the rigid conductive member comprises a plunger member which interconnectingly engages the rigid circuit and flex circuit and the first circuit comprises a printhead substrate, a TAB circuit or a stiffened flex circuit. In a preferred form of this invention, a carrier member is provided.

The first end of the rigid conductive member interconnecting engages with the rigid circuit and the second end of the rigid conductive member with the first major surface of the flex circuit. Furthermore, the first end of the compressive member interconnecting engages with the second major surface of the flex circuit and compressively urges the rigid conductive member for interconnecting engagement against the rigid circuit. In this way, the rigid circuit connects to the flex circuit to form a completed electrical circuit. The carrier member includes means for receiving and maintaining the rigid conductive member in interconnecting engagement with the rigid and flex circuits. The rigid conductive member is introduced into the carrier member where it interconnectingly engages the rigid conductive member and the rigid and flex circuits.

DETAILED DESCRIPTION OF A PREFERRED EMBODIMENT

Figure 1:
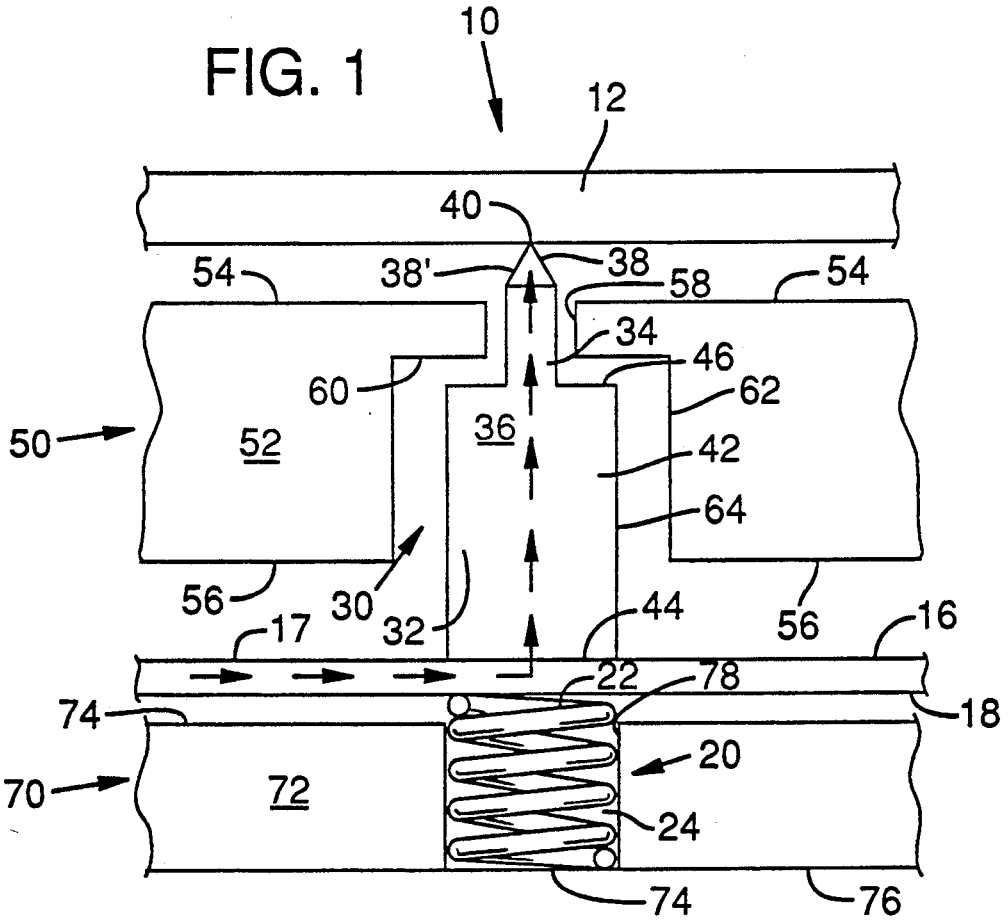
FIG. 1 is a schematic representation of an interconnected circuit system including a compressive member, a rigid conductive member and a flex member.

Referring now to FIG. 1, an interconnected circuit-to-circuit system 10 is schematically shown. The system 10 includes a thin film resistor rigid printhead substrate or a TAB circuit 12, such as the Hewlett Packard Deskjet ® printhead, which has been fabricated using state-of-the art semiconductor processing technique.

It is desired to connect the printhead substrate or TAB circuit or stiffened flex circuit 12 to a "flex" circuit 16. Flex circuit 16 first and second major outer surfaces 17 and 18. More specifically, circuit 12 can comprise a rigid circuit such as conventional printed circuit board with plated conductive metal pads, or a stiffened flexible circuit, such as conventional flex circuit laminated to a stiffened member or to a rigid member such as a PC board or to a rigid flat sheet of metal or plastic, and flex circuit 16 can comprise a conventional flex circuit, such as described in U.S. Pat. No. 4,706,097. However, the flex circuit is preferably formed without raised dimples.

The rigid circuit 12 and the flex circuit 16 are interconnected via a compressive member 20 in combination with rigid conductive member 30. The compressive member 20 is generally a spring member having first and second ends 22 and 24. More particularly, compressive member 20 comprises a coil spring which can fabricated of a metal or a polymeric material. The tension in compressive member 20 can be varied depending on the desired level of compression to be imparted to flex circuit 16 and in turn to rigid conductive member 30 and in turn to rigid circuit 12. If desired, the compressive member 20 can be conductive in nature.

The rigid conductive member 30, which is typically a plunger member 32, comprises a stem section 34 having an inner end 36 and an outer end 38 including pointed end portion 40. Inner end 36 of stem section 34 is joined to first end portion 46 of base section 42. Base section 42 has a second end portion 44 which interlockingly engages the second major surface 18 of flex circuit 16. Rigid conductive member 32 has an overall generally cylindrical configuration. Base section 42 is designed to have a larger relative cross-sectional diameter than stem sections 34.

The outer end 38 of first stem section 34 is designed to interlockingly engage circuit 12 by interconnection of the compressive conductive member 30 therewith. As shown in FIG. 1, outer end 38 has a pointed configuration which is fabricated to interconnectingly engage with circuit 12. In this way, conductive member 30 and circuit 12 are in intimate contact with each other thereby maintaining the requisite electrical circuit, i.e., electrical flow path. The outer end 38' can also have a generally rounded configuration (in phanthom) for interlockingly engaging circuit 12.

The interconnected system 10 is maintained intact with compressive member 20, flex circuit 16, rigid conductive member 30 and rigid circuit 12 being in an interconnectly engaged position so that the longitudinal axis of members 20 and 30 are substantially perpendicular to flex circuit 16 and to rigid circuit 12, respectively, through the use of a carrier member 50. Carrier members 50 which comprise a support base section 52, each carrier member 50 having outer surfaces 54 and 56. Carrier member also includes respective end section 58, inner surface 60, and support wall 62 which forms a chamber 66. Chamber 66 is sized to matingly receive stem section 34 and base section 42. In use, first stem section 34 is in fitting engagement with ledge section 58, inner surface 60 is in fitting engagement with first end section 46, and support wall 62 is in fitting engagement with outer wall 64 of base section 42. At the same time, compressive conductive member 20 is maintained in a substantially vertical position within the space defined by support wall 78 and floor section 76 of carrier member 70. Carrier member 70 includes base section 72 having an upper surface 74.

A prior art near-linear spring contact structure, denoted "58", is depicted in FIGS. 3A and 4 and in column 4, lines 3–59 of previously described U.S. Pat. No. 4,706,097. The compressive conductive member and a rigid conductive member of this invention also comprise a near-linear spring contact structure for the circuits 12 and 16, while acting to interconnect the subject circuit system 10. This means that the circuit system 10 of the present invention has a significantly lower final load $L_1$ requirement. As explained in detail in U.S. Pat. No. 4,706,097, this causes the printhead substrate or TAB circuit 12 to remain in intimate contact with the circuit 14 during use. This feature provides a design which ensures a high level of electrical contact therebetween. Similarly, circuit 12 and 16 are maintained in continuous electrical contact. This is accomplished through the use of the system 10 of the subject invention in which rigid circuit 12, compressive member 20, flex circuit 16 and rigid conductive member 30 are in intimate contact with each other so that an electrical path is maintained between the respective circuits.

Having illustrated and described the principles of my invention in a preferred embodiment thereof, it should be readily apparent to those skilled in the art that the invention can be modified in arrangement and detail without departing from such principles. I claim all modifications coming within the spirit and scope of the accompanying claims.

We claim:

1. A method for interconnecting a rigid circuit to a flex circuit, which comprises providing a rigid circuit and a flex circuit, said flex circuit having a first and a second major surface;

providing a rigid conductive member having a first end for interconnecting engagement with the rigid circuit and a second end for interconnecting engagement with the first major surface of the flex circuit;

providing a compressive member comprising a coil spring having a first end for interconnecting engagement with the second major surface of the flex circuit for compressively urging said rigid conductive member into interconnecting engagement against said rigid circuit;

interconnecting engaging the first end of the rigid conductive member with the rigid circuit and the second end of the rigid conductive member with the first major surface of the flex circuit; and interconnectingly engaging the first end of the compressive member with the second major surface of the flex circuit and compressively urging said rigid conductive member for interconnecting engagement against said rigid circuit thereby connecting the rigid circuit to the flex circuit to form a completed electrical circuit.

2. The method of claim 1, wherein the rigid conductive member comprises a plunger member which interconnectingly engages the rigid and flex circuits.

3. The method of claim 1, wherein the rigid conductive member comprises a plunger member which interconnectingly engages the rigid and flex circuits.

4. The method of claim 1, wherein the rigid circuit comprising a printhead substrate, a TAB circuit or a stiffened flex circuit.

5. The method of claim 1, wherein the rigid circuit comprising a printhead substrate, a TAB circuit or a stiffened flex circuit.

6. The method of claim 1, which further includes the steps of providing a carrier member including means for receiving and maintaining the rigid conductive member in interconnecting engagement with the rigid and flex circuits; introducing the rigid conductive member into the carrier member; and interconnectingly engaging the rigid conductive member and the rigid and flex circuits.

7. The method of claim 1, which further includes the steps of providing a carrier member including means for receiving and maintaining the rigid conductive member in interconnecting engagement with the rigid and flex circuits; introducing the rigid conductive member into the carrier member; and interconnectingly engaging the rigid conductive member and the rigid and flex circuits.

8. The method of claim 1, which further includes the step of fabricating the rigid conductive member of a metallic material.

9. The method of claim 1, wherein the first end of the rigid conductive member is formed in a substantially round or pointed configuration.

10. An interconnected rigid circuit-flex circuit system, which comprises a rigid circuit and a flex circuit, said rigid circuit having a first and a second major surface;

said flex circuit having a first and a second major surface;

a rigid conductive member having a first end for interconnecting engagement with the rigid circuit and a second end for interconnecting engagement with the first major surface of the flex circuit;

a compressive member comprising a coil spring having a first end for interconnecting engagement with the second major surface of the flex circuit for compressively urging said rigid conductive member into interconnecting engagement against said rigid circuit;

the first end of the rigid conductive member interconnectingly engaging with the rigid circuit and the second end of the rigid conductive member interconnectingly engaging with the first major surface of the flex circuit; and the first end of the compressive member interconnectingly engaging with the second major surface of the flex circuit and compressively urging said rigid conductive member for interconnecting engagement against said rigid circuit thereby connecting the rigid circuit to the flex circuit to form a completed electrical circuit.

11. The system of claim 10, wherein the rigid conductive member comprises a plunger member which interconnectingly engages the rigid and flex circuits.

12. The system of claim 11, wherein the rigid conductive member comprises a plunger member which interconnectingly engages the rigid and flex circuits.

13. The system of claim 10, wherein the rigid circuit comprising a printhead substrate, a TAB circuit or a stiffened flex circuit.

14. The system of claim 11, wherein the rigid circuit comprising a printhead substrate, a TAB circuit or a stiffened flex circuit.

15. The system of claim 10, which further includes the steps of providing a carrier member including means for receiving and maintaining the rigid conductive member in interconnecting engagement with the rigid and flex circuits; introducing the rigid conductive member into the carrier member; and interconnectingly engaging the rigid conductive member and the rigid and flex circuits.

16. The system of claim 11, which further includes the steps of providing a carrier member including means for receiving and maintaining the rigid conductive member in interconnecting engagement with the rigid and flex circuits; introducing the rigid conductive member into the carrier member; and interconnectingly engaging the rigid conductive member and the rigid and flex circuits.

17. The system of claim 10, which further includes the step of fabricating the rigid conductive member of a metallic material.

18. The system of claim 10, wherein the first end of the rigid conductive member is formed in a substantially round or pointed configuration.

19. An apparatus for connecting a first rigid circuit to a second flex circuit, which comprises a rigid conductive member having a first end for interconnecting engagement with the rigid circuit and a second end for interconnecting engagement with a first major surface of the flex circuit;

a compressive member comprising a coil spring having a first end for interconnecting engagement with a second major surface of the flex circuit for compressively urging said rigid conductive member into interconnecting engagement against said rigid circuit;

the first end of the rigid conductive member interconnecting engaging with the rigid circuit and the second end of the rigid conductive member interconnectingly engaging with the first major surface of the flex circuit; and the first end of the compressive member interconnecting engaging with the second major surface of the flex circuit and compressively urging said rigid conductive member into interconnecting engagement against said rigid circuit thereby connecting the rigid circuit to the flex circuit to form a completed electrical circuit.

* * * * *